United States Patent [19]

Shirley

[11] Patent Number: 4,635,736

[45] Date of Patent: Jan. 13, 1987

[54] DRILL STEERING APPARATUS

[76] Inventor: Kirk R. Shirley, 15719 Tumbling Rapids, Houston, Tex. 77084

[21] Appl. No.: 800,799

[22] Filed: Nov. 22, 1985

[51] Int. Cl.[4] ..... E12B 7/08

[52] U.S. Cl. ..... 175/76; 175/325

[58] Field of Search ..... 175/73, 76, 325; 308/4 A; 166/241

[56] References Cited

U.S. PATENT DOCUMENTS

| | | | |
|---|---|---|---|
| 3,916,998 | 11/1975 | Bass, Jr. et al. | 175/325 |
| 4,071,101 | 1/1978 | Ford | 175/325 |
| 4,101,179 | 7/1978 | Barron | 175/325 |
| 4,220,213 | 9/1980 | Hamilton | 175/325 |
| 4,394,881 | 7/1983 | Shirley | 175/76 |

*Primary Examiner*—James A. Leppink
*Assistant Examiner*—William P. Neuder
*Attorney, Agent, or Firm*—Vinson & Elkins

[57] ABSTRACT

An improved well drilling steering tool including a tubular body, an upper stabilizer mounted on the tubular body with a means contained therein for sensing the low side of the well bore and for transmitting hydraulic signals responsive thereto, valving means connected in the tubular body to control the end location for the hydraulic signals from the sensing means, a lower stabilizer mounted on the tubular body close to the drill bit and having means for exerting a transverse thrust to the tubular body responsive to the hydraulic signals received from the sensing means and the valving means, the upper and lower stabilizers are supported on the tubular body by upper and lower floating rings and retaining rings which cause the stabilizers to rotate with the tubular body and allow relative radial movement between the stabilizers and the tubular body and the stabilizers and their mounting rings include passages therebetween to prevent the build-up of materials within the stabilizers which would interfere with their operation.

9 Claims, 7 Drawing Figures

FIG.1
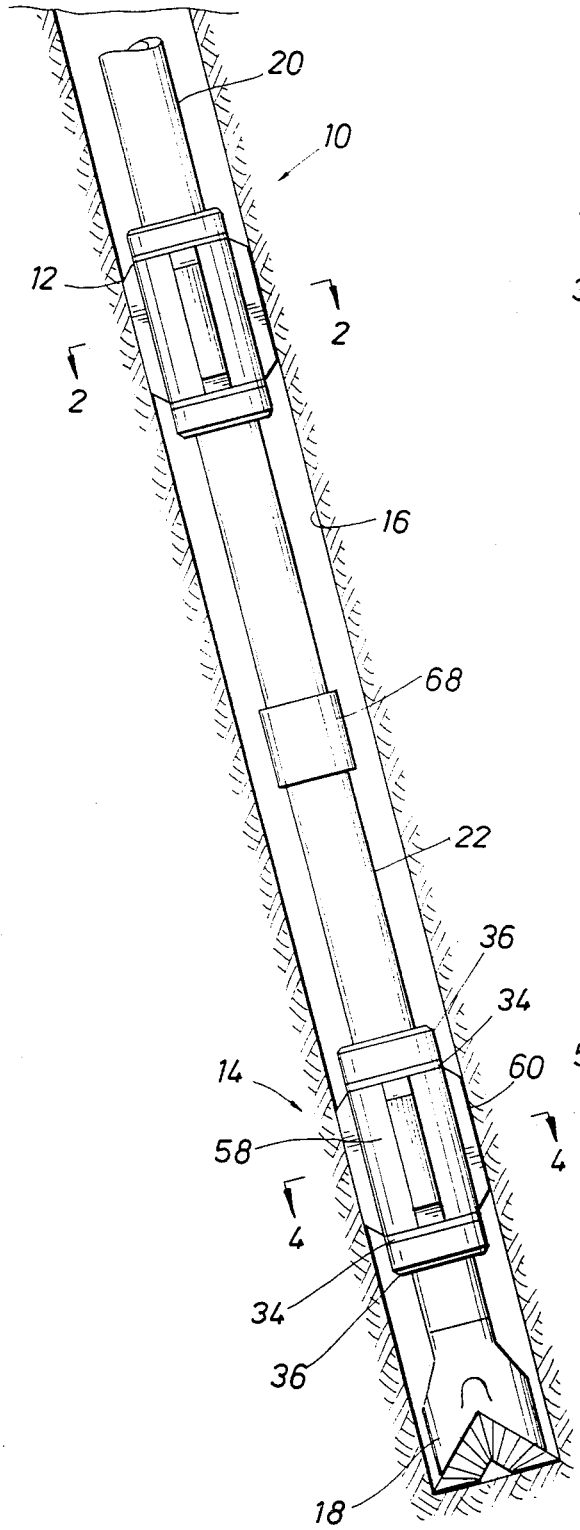
FIG. 2
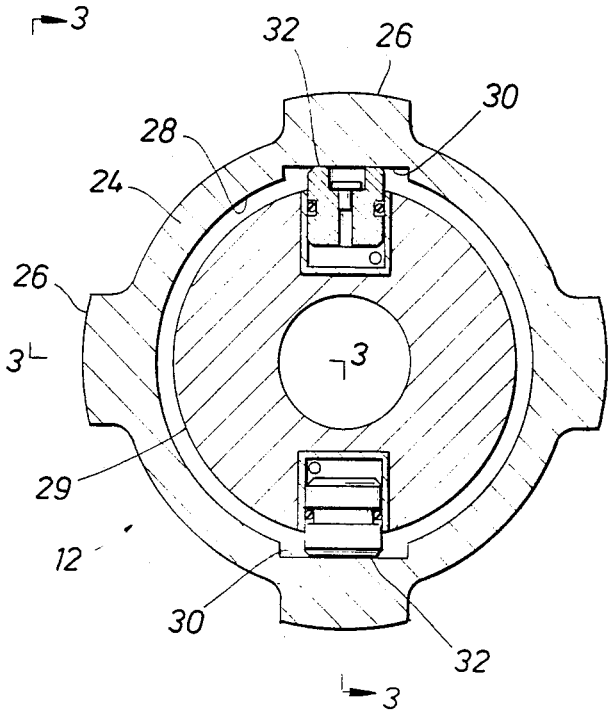
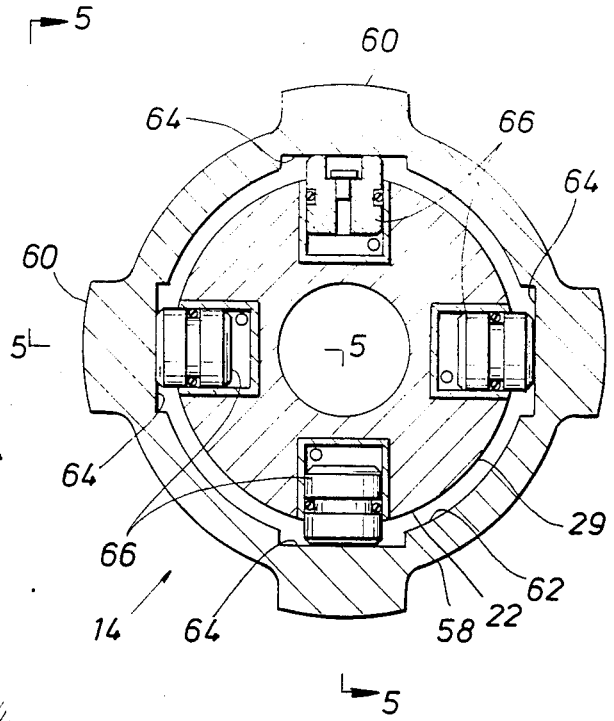
FIG. 4

FIG. 6
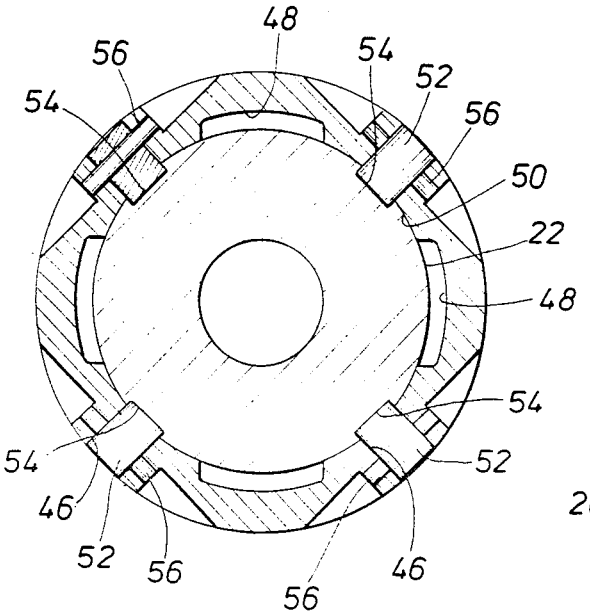
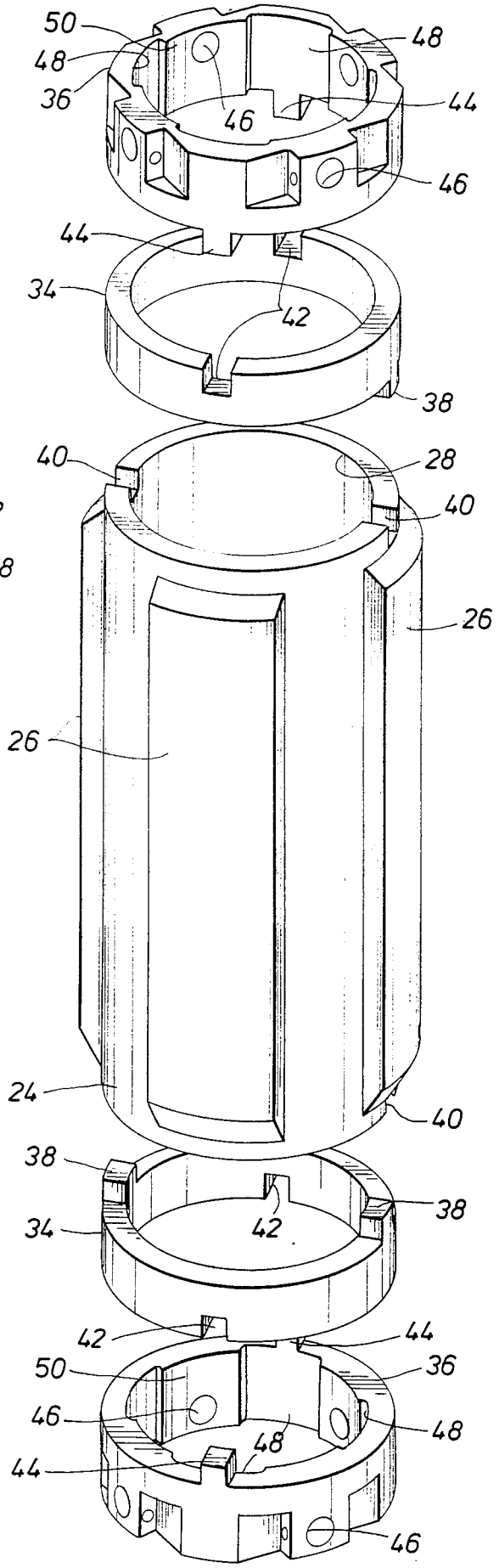
FIG. 7

DRILL STEERING APPARATUS

BACKGROUND

The drill steering apparatus similar to the present invention is disclosed in my prior U.S. Pat. No. 4,394,881. In such apparatus, stabilizer rings are mounted by retaining rings on the drill string one being immediately above the drill bit and another being spaced thereabove on the drill string. In each stabilizer ring are pistons, the upper of which has pistons which sense the low side of the well bore and the lower of which has pistons which exert a preselected force on the drill string responsive to the sensing of the low side of the well bore by the upper pistons. In this manner, the apparatus creates side thrusts on the drill bit which cause it to proceed in the well bore in the desired direction.

In the use of this apparatus, difficulty has been encountered in that the tool rotated within the stabilizer rings so that the stabilizers could not be rotated to ensure that the stabilizer rings could pass easily through tight spots and ledges which are prevalent in a well bore. Additionally, the retaining rings positioned above and below each of the stabilizer rings rotated with the drill string and their engagement of the ends of the stabilizer body creates sufficient heat to cause a failure of seals at the surface of the body ends and the retaining rings.

In the past stabilizers have long been used in the drilling of well bores to support the drill collars in directional drilling to control the angle of drilling. Such drill collars were tightly secured to the drill collar. Examples of such stabilizers are shown in U.S. Pat. Nos. 4,011,918 and 4,275,935.

In order to resolve the problem encountered by the stabilizer rings of the drill steering tool in moving through tight spots, the rotation of the drill string or tool body through the stabilizer ring had to be avoided so that the stabilizer ring could be rotated.

Another disadvantage of the prior steering tool was the accumulation of solids material between the stabilizer rings and the steering body which interfered with the operation of the steering apparatus.

SUMMARY

The present invention relates to an improved drill steering tool which relies on master sensing pistons which sense the low side of the well bore and slave pistons positioned close to the drill bit which respond to the sensed position by the master pistons and the preselected relationship between the two sets of pistons to control the side thrusts on the drill bit. The improved stabilizer rings include a ring body with outward projecting ribs or blades, internal pistons, and end slots in the ring body at each end, floating rings having projecting end lugs on one end of the ring for engaging within the end slots of the stabilizer ring body and slots on the other end of the floating ring which are ninety degrees apart from the end lugs, and retaining rings having end lugs projecting from one end for engagement in the slots of the adjacent floating ring, internal slots within the retaining rings and means for securing the retaining rings to the steering body. Each of the stabilizer rings is provided with a ring body between two floating rings with a retaining ring engaging each of the floating rings and secured to the steering body.

An object of the present invention is to provide an improved drill steering tool with stabilizer rings which are readily moved through tight spots and past ledges in the well bore.

Another object is to provide an improved drill steering apparatus with stabilizer rings which rotate with the body of the drill steering tool without sacrificing the action of the steering tool.

Still another object is to provide an improved drill steering apparatus having stabilizer rings in which packing off well material is not a problem.

BRIEF DESCRIPTION OF THE DRAWINGS

These and other objects and advantages of the present invention are hereinafter set forth and explained with reference to the drawings wherein:

FIG. 1 is an elevation view of the improved drill steering apparatus in a well bore.

FIG. 2 is a transverse sectional view of the upper stabilizer taken along line 2—2 in FIG. 1.

FIG. 4 is a transverse sectional view of the lower stabilizer taken along line 4—4 in FIG. 1.

FIG. 6 is a transverse sectional view through a retainer ring taken along line 6—6 in FIG. 3.

FIG. 7 is an exploded view of the improved stabilizer housing structure of the present invention.

DESCRIPTION OF THE PREFERRED EMBODIMENTS

Figure 3:
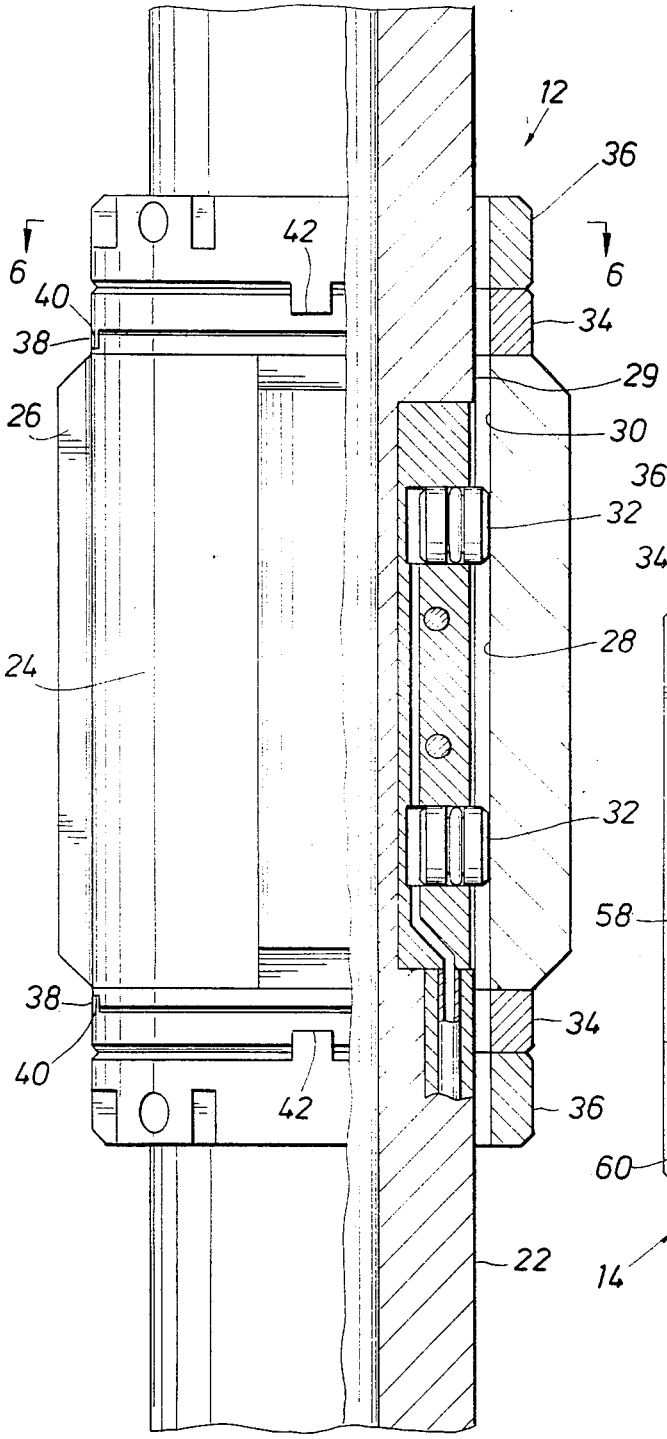
FIG. 3 is a longitudinal view (partly in section) of the upper stabilizer taken along line 3—3 in FIG. 2.

The improved steering tool 10 is similar to the tool shown in my aforementioned U.S. Pat. No. 4,394,881 with the exception that the upper and lower stabilizers have been replaced by improved upper stabilizer 12 and improved lower stabilizer 14. Steering tool 10 is shown positioned within well bore 16 with drill bit 18 on the lower end of steering tool 10 with the upper end of steering tool 10 being connected to drill string 20. The purpose of steering tool 10 is to control the direction of drilling of well bore 16, both as to direction and inclination. As is fully explained in my prior patent, this control is achieved through the use of stabilizers, the upper of which senses the low side of well bore 16 and transmits pressure to the lower stabilizer to cause it to exert a force on drill bit 18 to cause it to move in the direction in which it is desired that well bore 16 proceed. As previously mentioned, the prior steering tool had difficulty moving through tight spots in the well bore since the stabilizers did not rotate with the tool body and also mud and other materials in the well tended to collect in the annulus between the tool body and stabilizer ring I.D. preventing radial movement of the stabilizer rings.

The improved structure of the present invention avoids these difficulties with the new design of stabilizers 12 and 14. Each of stabilizers 12 and 14 is secured to rotate with body 22 of steering tool 10. Also, provision is made to clear the interior of the stabilizers so that materials in the well bore flow readily therethrough and are not trapped therein to interfere with the operations of the sensing pistons and the slave pistons.

Upper stabilizer 12, as shown in FIGS. 2 and 3, includes tubular body 24 having blades 26 extending longitudinally along its outer surface. Inner surface 30 of body 24 is spaced from the exterior surface 29 of body 22 and is recessed at 30 to receive sensing pistons 32 which are mounted in body 22 as shown. As can be seen from the drawings, there are four sensing pistons 32 in engagement with inner surface 28 of body 24 which include two pairs of opposed, axially spaced pistons 32. Tubular body 24 is secured to tool body 22 by upper and lower floating rings 34 and retaining rings 36. As first seen in FIG. 7, floating rings 34 have opposed projections 38 which engage within slots 40 in the ends of tubular body 24. Slots 42 in the opposite end of floating rings 34 from projections 38 are positioned at right angles to the radial position of the projections 38. Retaining rings 36 include projections 44 which engage within slots 42 of the floating rings 34, radial bores 46 and internal axial slots 48. Interior surface 50 of retainer rings 36 fits closely with the exterior of body 22. Retainer rings 36 are secured to body 22 by pins 52 which extend through radial bores 46 into recesses 54 in body 22 and are locked into position by lock pins 56 which extend through ring 36 and pins 52. The interiors of floating ring 34 and tubular body 24 are substantially larger than the exterior of body 22 to allow smooth operation of steering tool 10.

Figure 5:
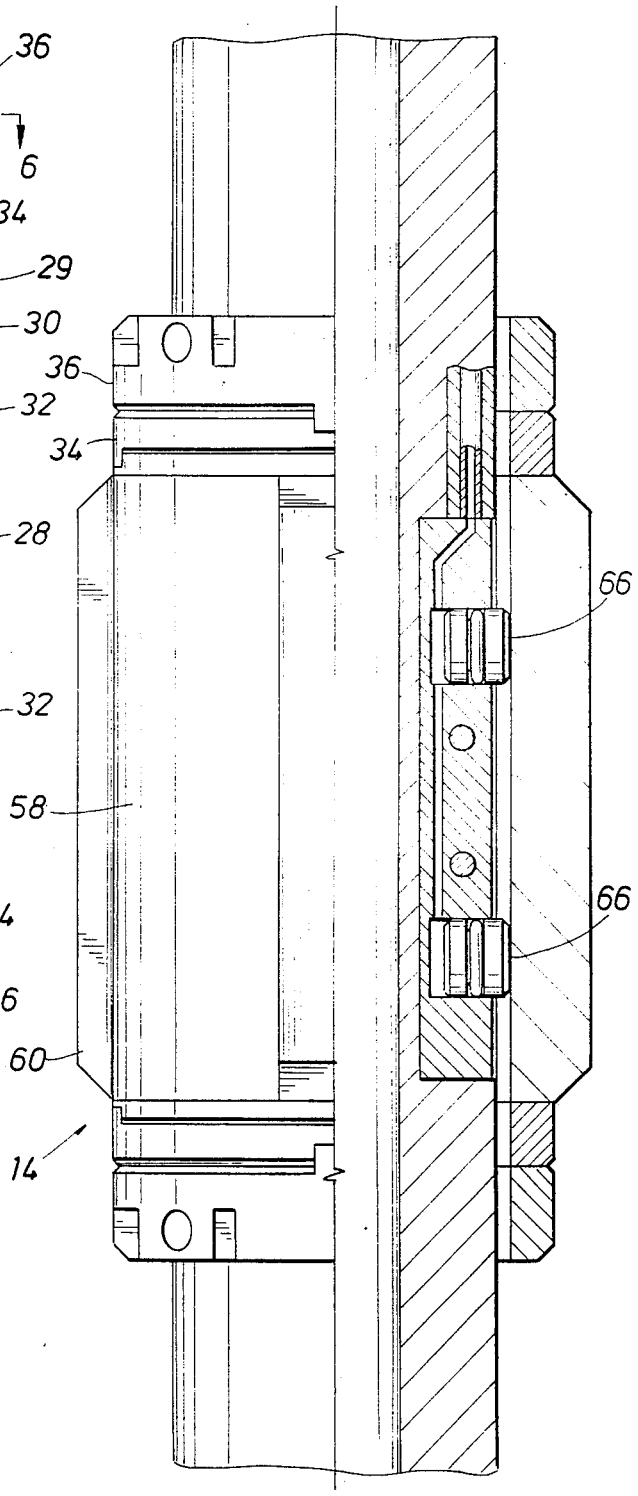
FIG. 5 is a longitudinal view (partly in section) of the lower stabilizer taken along line 5—5 in FIG. 4.

Lower stabilizer 14, as shown in FIGS. 4 and 5 includes tubular body 58 having blades 60 extending longitudinally along its outer surface. Inner surface 62 of body 58 is spaced from the exterior surface 29 of body 22 and is recessed at 64 to receive actuating or slave pistons 66. As can be seen from the drawings, there are eight sensing pistons 66 in engagement with inner surface 64 of body 58 which include two upper and two lower pairs of opposed, axially spaced pistons 66. Tubular body 58 is secured to tool body 22 by upper and lower floating rings 34 and upper and lower retaining rings 36. As described above with reference to upper stabilizer 12, the means supporting lower stabilizer 14 to tubular body 22 including rings 34 and 36 are identical in structure. Also, as shown in the drawings, pistons 32 and 66 include suitable sealing means to engage within the bores within which they are confined. Inserts 67 in body 22 is provided to the bores for receiving pistons which are axially aligned and to provide communication from the body passages to the pistons at the inner end of their bores.

Hydraulic communication is supplied through body 22 and adjustable valving means 68, as shown in my prior patent and reference is made thereto for a description of such structure, its operation whereby the connections between upper stabilizer 12 and lower stabilizer 14 and the relationship and operation of the other elements of the steering tool. With such means the interconnection in the hydraulic passages between the sensing pistons 32 and the actuating pistons 66 can be connected to cause drill bit 18 to be urged in the direction in which drilling of well bore 16 is desired to proceed. In this manner, well bore 16 can be brought back to vertical, or can be deviated at a specific angle to vertical and at a specific azimuth so that well bore 16 proceeds to a preselected location.

What is claimed is:

1. A steering tool comprising a tubular body having means on each end for connecting into a drill string at a position close to the drill bit, an upper stabilizer on said tubular body having means coacting between said tubular body and said upper stabilizer to sense the low side of the well bore being drilled, a lower stabilizer on said tubular body having means coacting between said tubular body and said lower stabilizer to impart a lateral thrust to the tubular body responsive to the sensing of the low side of the well bore by said upper stabilizer, means adjustably interconnecting said sensing means in said upper stabilizer to said thrust means in said lower stabilizer to provide thrust in a preselected direction to the lower end of said tubular body, and means for securing each of said stabilizers to said tubular body for rotation therewith and allowing freedom of relative movement between said tubular body and said stabilizers in radial directions.

2. A steering tool according to claim 1 wherein said securing means includes passage means between said securing means, said stabilizers and said tubular body to flush solids and semi-solids therefrom.

3. A steering tool comprising a tubular body having means on each end for connecting into a drill string at a position close to the drill bit, an upper stabilizer on said tubular body having means coacting between said tubular body and said upper stabilizer to sense the low side of the well bore being drilled, a lower stabilizer on said tubular body having means coacting between said tubular body and said lower stabilizer to impart a lateral thrust to the tubular body responsive to the sensing of the low side of the well bore by said upper stabilizer, means adjustably interconnecting said sensing means in said upper stabilizer to said thrust means in said lower stabilizer to provide thrust in a preselected direction to the lower end of said tubular body, and means for securing each of said stabilizers to said tubular body for rotation therewith and allowing freedom of relative movement between said tubular body and said stabilizers in radial directions, said stabilizer securing means each including a first ring secured to said tubular body above its stabilizer, a second ring interposed between said first ring and the upper end of said stabilizer, a third ring secured to said tubular body below its stabilizer, a fourth ring interposed between said third ring and the lower end of said stabilizer, said second and fourth rings interengaging slidably radially with their stabilizer and slidably radially with their secured ring and with the radially slidable movement being at right angles to each other.

4. A steering tool according to claim 3 wherein said interengagement between rings and stabilizers includes projections and mating slots allowing said radial movement.

5. A steering tool according to claim 3 wherein said interengagement between rings and stabilizers includes a universal connection securing said stabilizers to rotate with said tubular body and prevent their longitudinal movement thereon and allowing freedom of movement transversely with respect to the axis of said tubular body.

6. A steering tool comprising a tubular body having means on each end for connecting into a drill string at a position close to the drill bit, an upper stabilizer on said tubular body having means coacting between said tubular body and said upper stabilizer to sense the low side of the well bore being drilled, a lower stabilizer on said tubular body having means coacting between said tubular body and said lower stabilizer to impart a lateral thrust to the tubular body responsive to the sensing of the low side of the well bore by said upper stabilizer, means adjustably interconnecting said sensing means in said upper stabilizer to said thrust means in said lower stabilizer to provide thrust in a preselected direction to the lower end of said tubular body, and means for securing each of said stabilizers to said tubular body for rotation therewith and allowing freedom of relative movement between said tubular body and said stabilizers in radial directions, said stabilizer securing means including a pair of rings at each end of each stabilizer, said rings interconnecting to cause said stabilizers to rotate with said tubular body and provide freedom of movement radially of the axis of said tubular body.

7. A steering tool according to claim 6 wherein said interengagement between rings and stabilizers includes projections and mating slots allowing said radial movement.

8. A steering tool adapted to control the angle and direction of a rotary well drilling string in the drilling of a well bore through earth formation, said tool comprising:

an elongated body having an upper end connectible with the drilling string and a lower end connectible with the drilling string at a position close to the drill bit, a bore through said body for the flow of drilling fluid through the drilling string and the bit;

an upper stabilizer positioned on said elongated body;

master piston means in said upper stabilizer including a radially shiftable piston inwardly shiftable by engagement of the master piston means with the low side of the well bore wall;

a lower stabilizer positioned on said elongated body near the drill bit;

slave piston means in said lower stabilizer including a plurality of circumferentially spaced radially shiftable pistons for applying lateral thrust on the lower end of said body upon radial outward movement, said body having a valve chamber between said master piston means and said slave piston means;

fluid passage in said body establishing communication between said valve chamber and each of said slave piston means;

selective valve means in each of said passages between said valve chamber and said slave piston means for establishing fluid pressure communication through said valve chamber between said master piston means and selected passages between said valve chamber and said valve piston means to cause radial outward movement of a selected slave piston upon radial inward movement of said master piston; and means for securing each of said stabilizers to said tubular body including a pair of rings at each end of each stabilizer, said rings interconnecting to cause said stabilizers to rotate with said tubular body to provide freedom of movement radially of the axis of said tubular body.

9. A steering tool according to claim 8 wherein said securing means includes passage means between said securing means, said stabilizers and said tubular body to flush solids and semi-solids therefrom.

* * * * *